US007673909B2

(12) United States Patent
Rousselet

(10) Patent No.: US 7,673,909 B2
(45) Date of Patent: Mar. 9, 2010

(54) DUAL-ADHESIVE LABEL FOR APPLYING TO AN ARTICLE, PARTICULARLY AN ITEM OF COSMETIC PRODUCT PACKAGING

(75) Inventor: Guilhem Rousselet, Saint Maur des Fosses (FR)

(73) Assignee: L'Oreal, Paris (FR)

( * ) Notice: Subject to any disclaimer, the term of this patent is extended or adjusted under 35 U.S.C. 154(b) by 587 days.

(21) Appl. No.: 10/859,309

(22) Filed: Jun. 3, 2004

(65) Prior Publication Data

US 2005/0012324 A1 Jan. 20, 2005

Related U.S. Application Data

(60) Provisional application No. 60/484,292, filed on Jul. 3, 2003.

(30) Foreign Application Priority Data

Jun. 3, 2003 (FR) ..... 03 06682

(51) Int. Cl.
*B42D 15/00* (2006.01)
*B32B 33/00* (2006.01)

(52) U.S. Cl. ..... 283/101; 283/81; 428/41.9; 428/42.1

(58) Field of Classification Search ..... 428/40.1, 428/42.1–42.3, 43, 41.9, 354; 283/72, 81, 283/94, 98, 101, 117, 901
See application file for complete search history.

(56) References Cited

U.S. PATENT DOCUMENTS 3,524,782 A * 8/1970 Buske ..... 156/248

(Continued)

FOREIGN PATENT DOCUMENTS

FR 2441894 6/1980

(Continued)

OTHER PUBLICATIONS http://www.flexcon.com/new_arch2.asp?ID=12&type=1.*

*Primary Examiner*—Dana Ross
*Assistant Examiner*—Pradeep C Battula
(74) *Attorney, Agent, or Firm*—Oblon, Spivak, McClelland, Maier & Neustadt, L.L.P.

(57) ABSTRACT

A label intended to be applied to an article, and in particular to an item of cosmetic product packaging. The label includes a substrate having a first face which is covered, at least in part, by a first printing. A second face of the substrate is intended to be adhesive-bonded to the article. At least one first zone of the second face is covered by a first adhesive layer intended to hold the label in place on the article permanently. At least one second zone of the second face is covered by a second adhesive layer, different from the first one, with the second adhesive layer being such that the second zone is able to be unstuck from the article. The substrate also includes a second printing arranged so that, when the article is not transparent, the second printing is visible only when the second zone is unstuck from the article. In an alternate arrangement, the same adhesive can be used in the different zones of the second face, and the second printing is provided over the adhesive in the second zone, such that the second printing weakens or diminishes the adhesive strength of the adhesive to allow the second zone to be unstuck or peeled from the article to view the second printing.

52 Claims, 2 Drawing Sheets

U.S. PATENT DOCUMENTS 4,068,028 A * 1/1978 Samonides ..... 428/41.4
4,721,638 A * 1/1988 Matsuguchi et al. ..... 428/42.1
4,826,213 A * 5/1989 Matsuguchi et al. ..... 283/108
4,876,123 A * 10/1989 Rivera et al. ..... 428/34.2
4,889,234 A * 12/1989 Sorensen et al. ..... 206/459.5
4,894,110 A * 1/1990 Lass et al. ..... 156/272.8
4,902,141 A * 2/1990 Linnewiel ..... 383/61.1
5,019,436 A * 5/1991 Schramer et al. ..... 428/41.9
5,284,688 A * 2/1994 Hiatt ..... 428/41.4
5,582,889 A * 12/1996 Pedrini ..... 428/41.9
5,676,785 A * 10/1997 Samonides ..... 156/244.11
5,824,380 A * 10/1998 Hagen ..... 428/41.9
6,073,377 A 6/2000 Mehta
6,113,271 A * 9/2000 Scott et al. ..... 383/211
6,332,631 B1 12/2001 Kirk
6,358,607 B1 * 3/2002 Grotzner et al. ..... 428/354
2002/0182359 A1 * 12/2002 Muir et al. ..... 428/40.1
2003/0034645 A1 * 2/2003 Dronzek et al. ..... 283/81
2004/0028866 A1 * 2/2004 Sellars ..... 428/40.1

FOREIGN PATENT DOCUMENTS

GB 2310418 8/1997

* cited by examiner

DUAL-ADHESIVE LABEL FOR APPLYING TO AN ARTICLE, PARTICULARLY AN ITEM OF COSMETIC PRODUCT PACKAGING

CROSS REFERENCE TO RELATED APPLICATIONS

This document claims priority to French Application Number 03 06682, filed Jun. 3, 2003 and U.S. Provisional Application No. 60/484,292, filed Jul. 3, 2003, the entire contents of which are hereby incorporated by reference.

FIELD OF THE INVENTION

The present invention relates to a label intended to be applied to an article. The invention is particularly advantageous for use in cosmetic products, for example, to provide a label upon an item of cosmetic product packaging.

BACKGROUND OF THE INVENTION

Discussion of Background

In the field of cosmetics, a large amount of information can be required to be shown in a permanent form on the packaging for the products. For example, it is typically mandatory for products to include a list of the constituents or ingredients of the product formulations and also other particulars such as the batch number of the products or any other information which enables the product to be traced. This information must also be given in addition to the marketing information relating to the product. In addition, all these details often have to appear on products having small dimensions such as, for example, tubes of mascara, bottles of nail varnish or tubes of lipstick. Further, the details must not spoil the aesthetic appeal of the product to which they are applied.

To enable all of this information to be given, one possible solution is to apply two labels in order to obtain a sufficiently large printable area. However, this can be a costly solution because it involves an extra label and a label-applying station. The requirement for an additional label-applying station can be costly and/or inconvenient due not only to the cost of the label-applying equipment, but also due to the need to redesign the packaging line and allocate space for the additional station. Furthermore, it is often difficult for two labels to be applied to an article because, in the field of make-up, the articles are relatively small and the areas to which labels can be applied are thus restricted in size. Finally, this solution may not be aesthetically appealing.

FR 2441894 calls for a single relatively sizeable label to allow all the desired details to be printed, with the details marked on the front face of the label. This document also describes that some of the details relating to the product can be detached from the rest of the label, and therefore, not all the details are applied to the product permanently. In addition, this arrangement can suffer from problems resulting from lack of available space for smaller articles and/or poor aesthetics as discussed above.

Another possible solution consists of using an extended-text label or a peelable label rather than a simple label.

An extended-text label is a label made up of two printable layers which are applied to a substrate one on top of the other. The two layers are thus applied in a single operation at a single labeling station. The two layers are secured to one another over most of their area by a low-strength adhesive and at a lateral strip by a high-strength adhesive. The consumer can thus unstick the top layer of the label, on which some of the information is printed, in order to gain access to what is printed on the bottom layer of the extended-text label. By pulling harder on the top layer, the consumer is finally able to unstick the entire top layer of the extended-text label.

A peelable label is a label which is likewise made up of two printable layers which are applied to a substrate one on top of the other. The two layers are applied at a single labeling station. With this arrangement, the two layers are secured to one another by a low-strength adhesive over their entire area. The consumer is thus easily able to unstick the top layer of the peelable label in order to gain access to what is printed on the bottom layer of the peelable label.

However, both of the above labels have a number of disadvantages. The labels are costly because they contain two substrate layers rather than just one. Also, they require sophisticated technology because the layers each have to be printed separately before they are stuck to one another. Furthermore, in-line printing is more complex due to the extra thickness of the two layers which can cause more wear on the printing heads than with a conventional single-layer label. Finally, when the consumer pulls off the top layer of the label, he or she separates all the particulars which are printed on the top layer, which can be unacceptable because this information can then be detached from the product. Accordingly, this needed information could be lost, which is inconsistent with the purpose of the label, namely, to retain the information with the product. In addition, the consumer may be tempted to pull off the top layer before actually buying (particularly since there is generally a pictogram to suggest how to do so), without feeling that he or she is spoiling the product. However, an action of this kind degrades the product and can make it unsaleable.

U.S. Pat. No. 6,332,631 describes a label containing a support or substrate, a first face of which is covered with a first indication or information. The second face of the support contains a first portion covered with a permanent adhesive intended to fix the label. The second face contains a second portion initially covered with an adhesive on which a second indication or information is printed, with the adhesive power of the adhesive in this second portion being deactivated by a barrier coating. A third portion is covered with an adhesive, with this portion being intended to be unstuck.

Documents GB2310418 and U.S. Pat. No. 6,073,377 describe labels containing two detachable parts, a single face of which contains an indication or information.

SUMMARY OF THE INVENTION

It is therefore one of the objects of the invention to provide a label which avoids at least some of the drawbacks of the prior art.

It is another object of the invention to provide a label having small dimensions and which allows a large amount of information to be shown.

It is yet another object of the invention to provide a label whose cost is relatively low.

It is a further object of the invention to provide a label which does not spoil the aesthetic appeal of the article to which it is applied.

In accordance with the invention, these objects can be achieved by providing a label intended to be applied to an article, for example to an item of cosmetic product packaging, in which the label includes a substrate having a first face which is covered, at least in part, by a first printing. A second face of the substrate is intended to be adhesive-bonded to the article, and the second face includes an adhesive layer intended to hold at least one first zone of the label in place on the article permanently. The adhesive layer is at least partly covered, on at least one second zone of the second face, with a second printing relating to the article or product. The second printing is intended to be in contact with the article when the label is stuck on the article, with the second printing allowing a decrease in the adhesive power of the adhesive layer in the second zone so that the second zone is capable of being unstuck from the article and the user can review the second printing. In a disclosed example, the adhesive power of the adhesive layer is only decreased by the presence of the second printing (corresponding to an indication relative to the article), without requiring an additional layer on the adhesive.

In accordance with a second example of the invention, the above objects can also be achieved by providing a label intended to be applied to an article, such as an item of cosmetic product packaging, in which the label includes a substrate having a first face covered, at least in part, by a first printing, with a second face of the substrate intended to be adhesive-bonded to the article. At least one first zone of the second face is covered by a first adhesive layer intended to hold the label in place on the article permanently, and at least one second zone of the second face is covered by a second adhesive layer, different from the first one, with the second composition being such that the second zone is able to be unstuck from the article. The substrate includes a second printing arranged so that, when the article (i.e., the article to which the label is attached) is not transparent, the second printing is visible only when the second zone is unstuck from the article.

In this second configuration, the second printing can cover at least part of the second zone of the second face of the substrate. Alternately, the substrate can be transparent and the second printing can cover a part of the first face of the substrate which is arranged opposite the second zone of the second face of the substrate, with the second printing then being covered by an opaque printing.

As used herein, holding the label in place "permanently" means that the first zone of the label is not unstuck from the article by normal peeling, but it is not totally impossible to unstick it. It is not excluded that it can be unstuck, for example, by scratching strongly on the label or by applying a chemical composition. Also, unless further specified, "face" is used to designate the sides of the substrate, without necessarily requiring direct contact with the surface of the substrate. For example, in referring to the second printing being provided on the second face of the substrate, the second printing can be provided over an adhesive of the second face, and thus, the second printing need not be in direct contact with or on the surface of the second face.

In accordance with an aspect of the invention, some of the details can be read on the front face of the label and the rest can be read, after part of the label has been unstuck, on or through the rear face of the label, which increases the printable area of the label (or the area on which printing can be viewed) without increasing its size. Of course, when a label of this kind is applied to an article through which the label can be seen, i.e. a non-opaque article, the second printing may be seen through the article itself without there being any need for the label to be unstuck.

By way of example, the substrate may be made of a material selected from the high-density polyethylenes, the polypropylenes, the polyvinyl chlorides, the polyethylene terephthalates, or paper. This peelable strip can be used to ease handling of the labels before they are to be applied to articles. The peelable strip can then be removed in order to apply the labels to the articles.

Also by way of example, the thickness of the substrate can be between 12 μm and 200 μm, and preferably between 20 μm and 80 μm.

A peelable strip may be applied to the adhesive layer, with the face of the peelable strip which is in contact with the adhesive layer being covered with an anti-adhering material. For example, silicone can be used to provide an anti-adhering material. The peelable strip may be made, for example, of a material selected from the polyethylene terephthalates, the polypropylenes, or paper.

In accordance with another aspect, an item of packaging for a product, such as a cosmetic product, is provided having a label as discussed above. For example, the item of packaging can be in the form of a box, a case, a pot or jar, a bottle, a tube, a can, or a stick or pencil of make-up.

BRIEF DESCRIPTION OF THE DRAWINGS

The invention will become further apparent from the following detailed description, particularly when considered in conjunction with the drawings in which.

DETAILED DESCRIPTION OF THE PREFERRED EMBODIMENTS

Figure 1:
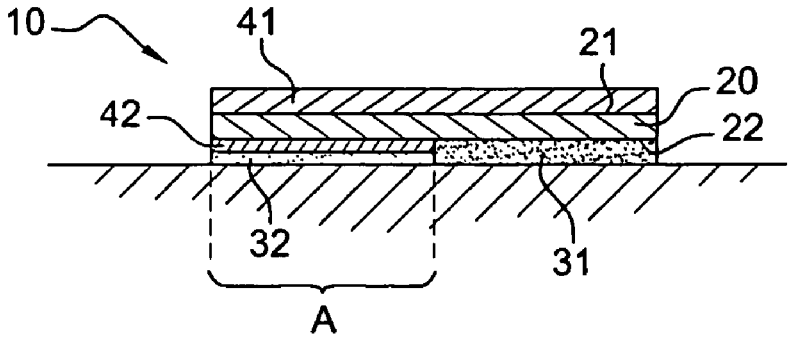
FIG. 1 is a view in cross-section of a first embodiment of a label according to the invention.
Figure 4B:
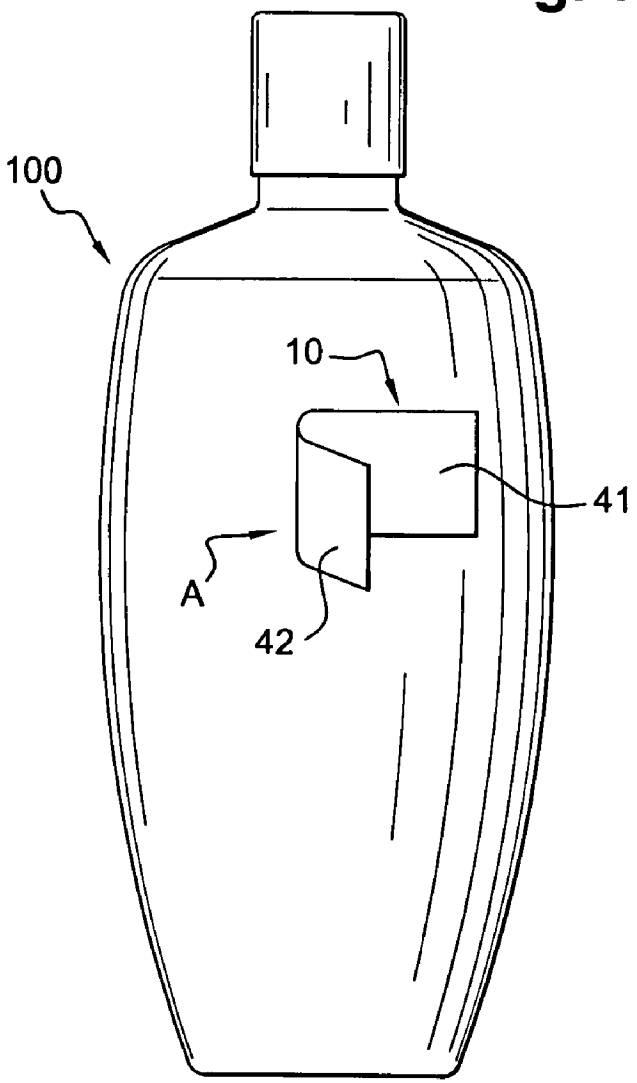
FIG. 4B shows the bottle of FIG. 4A when a part A of the label is unstuck from the bottle.
Figure 4A:
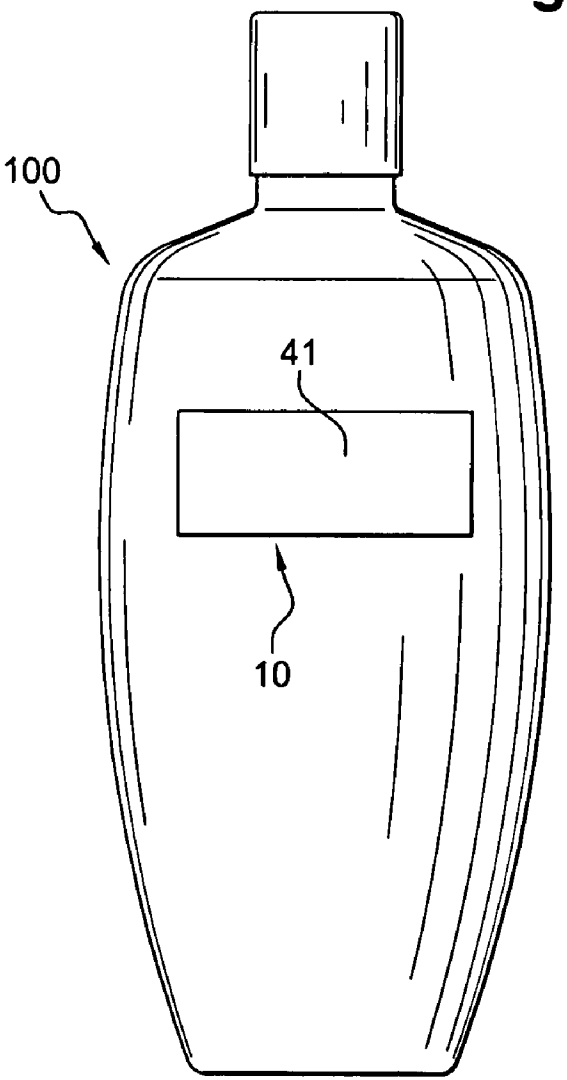
FIG. 4A shows a bottle provided with the label shown in FIG. 1.

The label 10 shown in the example of FIGS. 1, 4A and 4B is substantially rectangular in shape, as can better be seen in FIGS. 4A and 4B. The label includes a substrate 20 formed, for example, of high-density polyethylene, polypropylene, polyvinyl chloride, paper or polyethylene terephthalate. Purely by way of illustration, in the case of a substrate of high-density polyethylene its thickness can be on the order of 80 to 100 μm. In the case of a polypropylene, its thickness can be, for example, on the order of 40 to 60 μm. In the case of paper, its thickness can be, for example, on the order of 100 μm. Other materials could also be used. The substrate is preferably opaque.

A first face 21 of the substrate 20, which face forms the front face or front side of the label, is at least partially covered by a first printing represented at 41. By way of example, the first printing can include one or more particular details relating to the identity of the product, its trademark or trade name, and especially the required items of information such as the batch number of the product, how much of it is supplied or contained in the container, the packager's address and code, or items of commercial information such as a bar code, etc. The printing is done by any known technique, for example, by screen printing, letterpress printing, flexographic printing or offset printing.

The first printing 41 is intended to be seen by the consumer, in the preferred form without requiring the consumer to perform any special action or steps.

A second face 22 of the substrate 20, which face forms the rear face or rear side of the label, is covered, over a part A only of its area which preferably extends to an end of the label, by a second printing 42. The second printing 42 includes, for example, details relating to the list of compounds or ingredients of the product contained in the article to which the label is applied. This printing can also be done by any known technique including, for example, screen printing, letterpress printing, flexographic printing or offset printing.

The second printing 42 is preferably not directly visible to the consumer when he or she looks at the product before a portion of the label is peeled away.

The rest of the area of the second face 22 is covered by a first adhesive composition 31 and particularly an adhesive of the permanent or semi-permanent type. The first adhesive composition 31 is intended to adhesively-bond the label permanently to the article.

The second printing 42 is covered by a transparent second adhesive composition 32 whose power of adhesion or adhesive strength is less than that of the first adhesive composition, so that part A of the label can be unstuck from the article to which it is applied.

The adhesive compositions 31 and 32 can be covered, before use (e.g., before they are to be applied to a container), with a peelable strip (not shown), for example, a strip made of a material selected from the polyethylene terephthalates, the polypropylenes, or paper. That face of the peelable strip which is in contact with the adhesive compositions 31 and 32 is covered with an anti-adhering layer, such as a layer of silicone. The peelable strip is pulled off just before the label 10 is applied to the packaging.

To produce the label 10, the first face 21 of the substrate is printed with the printing 41. Part A of the second face 22 of the substrate is then printed with the printing 42 and the printing 42 is coated with the adhesive composition 32. The rest of the second face 22 is coated with the adhesive composition 31. The peelable protective strip is then applied to the adhesive layers.

FIGS. 4A and 4B show an example of an item of packaging 100 carrying a label 10 of the kind described above. An item of packaging in the illustrated embodiment is a container in the form of a bottle, with the label 10 being applied to the body of the bottle. Alternatively, the label can be adhesive-bonded to the cap of the bottle. An item of packaging of this kind could also be formed by a container in the form of a pot or jar, a tube, or a can of the aerosol or spray type. Alternatively, the item of packaging may be in the form of a box or case, or a stick or pencil of make-up.

The bottle 100 contains, for example, a cosmetic product and is marketed with the label 10, which has been adhesive-bonded to it (after the peelable strip was pulled off). As can be seen in FIG. 4A, the consumer is able to read the details formed by the first printing 41 without performing any special action. To read the details formed by the second printing 42, the user peels or unsticks part A of the label in order to see part A of the rear face of the label which carries the second printing 42. With the substrate 20 being opaque, the first printing 41 is thus not visible through the support and the consumer sees only the second printing 42. Also, since the rest of the label is adhesive-bonded by an adhesive composition of the permanent type, the label is held in place on the article and all the details printed on the label thus remain on the article permanently.

Figure 2:
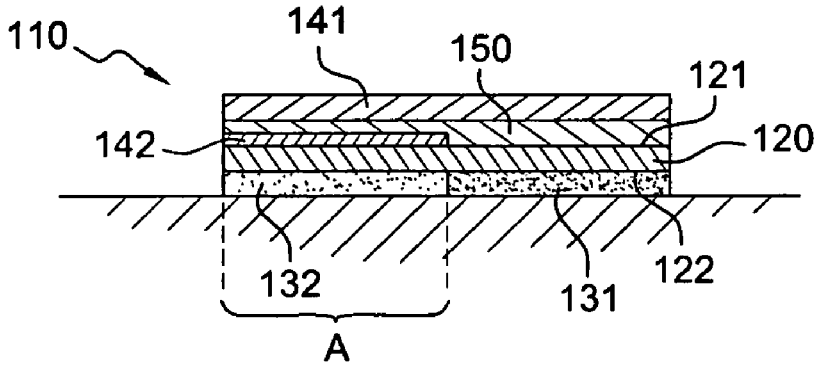
FIG. 2 is a view in cross-section of a second embodiment of a label according to the invention.

In a second embodiment, which is shown in FIG. 2, the label 110 includes a substrate 120 which may be substantially identical to the substrate 20 described above except that this time the substrate is transparent. With this arrangement, the first face 121 of the substrate 120, which face forms the front face or front side of the label, is covered, over a part A only of its area which preferably extends to the end of the label, by a second printing 142. This second printing 142 can include information, for example, identical to the second printing described above and represents, for example, details relating to the list of compounds or ingredients of the product contained in the article to which the label is applied.

An opaque layer of printing 150 forms a continuous cover over the rest of the area of the first face 121 of the substrate and over the second printing 142. Finally, the first printing 141 this time covers the layer 150.

The second face 122 of the substrate 120, which forms the rear face of the label, is covered, over a part only of its area which extends to the end of the label (and which constitutes part A of the label), by a transparent second adhesive composition 132 whose power of adhesion is relatively low, so that part A of the label can be unstuck or peeled from the article to which it is applied. The rest of the area of the second face 122 is covered by a first adhesive composition 131, and in particular by an adhesive of the permanent or semi-permanent type. The first adhesive composition 131 is intended to adhesively-bond the label to the article permanently.

In the same way as in the previous embodiment, the first printing 141 is intended to be seen by the consumer without requiring the consumer to perform any special action or steps. Also, the presence of the opaque layer 150 conceals the second printing 142 before a portion of the label is peeled from the container, such that the second printing is not visible when looking at the front or first face of the substrate. To read the details given by the second printing 142, the user unsticks part A of the label in order to see the part A of the rear face of the label which carries the second printing 142. Since the substrate 120 is transparent, the second printing 142 is thus visible through the substrate. Also, the presence of the opaque layer 150 conceals the first printing 141 when part A is unstuck so that the first printing is not visible when looking at the second or rear face of the substrate.

To produce this label 110, the printing 142 is printed on part A of the first face 121 of the substrate. The opaque layer 150 is then provided (e.g., by printing) over the printing 142 and over the rest of the first face 121 of the substrate. Then, the printing 141 is printed on the opaque layer 150. Finally, the second face 122 of the substrate is coated with the adhesive compositions 131 and 132.

Figure 3:
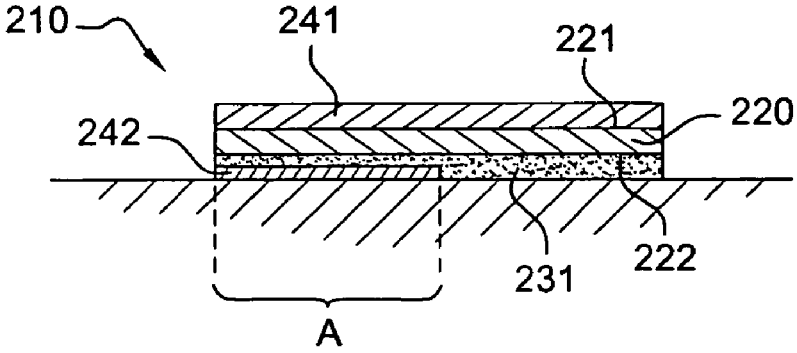
FIG. 3 is a view in cross-section of a third embodiment of a label according to the invention.

The third embodiment, which is shown in FIG. 3, differs from the first embodiment in that, with this example, the second face 222 of the substrate 220 is entirely covered by a first adhesive composition 231, of the permanent or semi-permanent type, which is not necessarily transparent. The second printing 242 this time covers a part A of the first adhesive composition 231, so that the power of adhesion of the latter composition is partly cancelled out or weakened, which enables part A of the label to be unstuck or peeled from the article to which it is applied.

To produce the label 210, the printing 241 is printed on the first face 221 of the substrate. The entire second face 222 of the support can then be coated with the adhesive composition 231. Finally, the printing 242 is printed on a part A of the adhesive composition.

In the foregoing detailed description, reference has been made to preferred embodiments as examples of the invention. It is clear that variations may be made without thereby departing from the invention as claimed below. It is therefore to be understood that, within the scope of the appended claims, the invention may be practiced otherwise than as specifically described herein.

What is claimed as new and desired to be secured by Letters Patent of the United States is:

1. A label which can be applied to an article comprising:

a substrate including a first face and a second face;

a first printing covering at least part of the first face;

wherein the second face of the substrate is intended to be adhesive-bonded to the article, and wherein an adhesive layer that consists of a first adhesive covers the second face in at least one first zone and in at least one second zone of the second face to hold the at least one first zone and the at least one second zone of the label in place on the article;

wherein the first adhesive entirely covers the at least one first zone of the second face and the at least one second zone of the second face of said substrate so as to completely coat the second face of said substrate in the at least one first zone of the second face and in the at least one second zone of the second face;

wherein in the at least one second zone of the second face, the adhesive layer is at least partly covered by a second printing that directly contacts the first adhesive, that corresponds to an indication relative to the article and that is intended to be in direct contact with the article when the label is stuck on the article so that the second printing provides a decrease in adhesive strength of the adhesive layer in the at least one second zone; and wherein the adhesive layer holds the at least one first zone in place on the article permanently while the adhesive layer in the at least one second zone, having a decreased adhesive strength, peelably adheres the label in place in the second zone such that it can be unstuck from the article to show the second printing.

2. A label according to claim 1, wherein the substrate is made of at least one material selected from the group consisting of high-density polyethylenes, polypropylenes, polyvinyl chlorides, polyethylene terephthalates, and paper.

3. A label according to claim 1, wherein the substrate has a thickness in the range of 12 μm to 200 μm.

4. A label according to claim 1, wherein the substrate has a thickness in the range of 20 μm to 80 μm.

5. A label according to claim 1, further including a peelable strip applied to the adhesive layer, and wherein a face of the peelable strip which is in contact with the adhesive layer is covered with an anti-adhering material.

6. A label according to claim 5, wherein the anti-adhering material includes silicone.

7. A label according to claim 5, wherein said peelable strip is made of at least one material selected from the group consisting of polyethylene terephthalates, polypropylenes, and paper.

8. An article, comprising:

the label according to claim 1, wherein the label is applied with the label adhered to said article, and wherein the article includes a cosmetic product.

9. The article according to claim 8, wherein said article is a container which contains said cosmetic product.

10. The article according to claim 8, wherein said article is a bottle.

11. The article according to claim 8, wherein said second printing is in contact with said article prior to the second zone being unstuck from the article.

12. The label according to claim 1, wherein the adhesive layer is interposed between the second printing and the substrate such that the adhesive layer is in direct contact with the second face and such that the second printing is in direct contact with the adhesive layer.

13. A label which can be applied to an article comprising:

a substrate including a first face and a second face, the second face being one unitary piece which lies in the same plane;

a first printing covering at least part of the first face;

wherein the second face of the substrate is intended to be adhesive-bonded to the article, said second face including at least one first zone and at least one second zone, and wherein the at least one first zone of the second face is entirely covered by a first adhesive layer intended to hold the label in place on the article permanently, and further wherein the at least one second zone of the second face is entirely covered by a second adhesive layer different from the first adhesive layer, and further wherein the second adhesive layer allows the at least one second zone to be peelably adhered to the article, and further wherein the at least one second zone directly abuts the at least one first zone; and a second printing which is positioned between the first printing and the first face of the substrate, which is not directly visible when the second zone is adhered to the article, and which is visible when the second zone is peeled away from the article.

14. A label according to claim 13, wherein the substrate is made of at least material selected from the group consisting of high-density polyethylenes, polypropylenes, polyvinyl chlorides, polyethylene terephthalates, and paper.

15. A label according to claim 13, wherein the substrate has a thickness in the range of 12 μm to 200 μm.

16. A label according to claim 13, wherein the substrate has a thickness in the range of 20 μm to 80 μm.

17. A label according to claim 13, further including a peelable strip applied to the adhesive layer, and wherein a face of the peelable strip which is in contact with the adhesive layer is covered with an anti-adhering material.

18. A label according to claim 17, wherein the anti-adhering material includes silicone.

19. A label according to claim 17, wherein said peelable strip is made of at least one material selected from the group consisting of polyethylene terephthalates, polypropylenes, and paper.

20. An article, comprising:

the label according to claim 13, wherein the label is applied with the label adhered to said article, and wherein the article includes a cosmetic product.

21. The article according to claim 20, wherein said article is a container which contains said cosmetic product.

22. The article according to claim 20, wherein said article is a bottle.

23. The article according to claim 20, wherein the first adhesive layer is in contact with said article and in contact with said substrate in the first zone of the second face of the substrate.

24. The article according to claim 20, wherein said article is not transparent such that said second printing is only visible when the second zone is unstuck from the article.

25. A label which can be applied to an article comprising:

a substrate including a first face and a second face, the second face being one unitary piece which lies in the same plane;

a first printing covering at least part of the first face;

wherein the second face of the substrate is intended to be adhesive-bonded to the article, said second face including at least one first zone and at least one second zone, and wherein the at least one first zone of the second face is entirely covered by a first adhesive layer intended to hold the label in place on the article permanently, and further wherein the at least one second zone of the second face is entirely covered by a second adhesive layer different from the first adhesive layer, and further wherein the second adhesive layer allows the at least one second zone to be able to be unstuck from the article; and a second printing which is visible when looking only at the second zone, wherein the substrate is at least partially transparent and wherein the second printing covers a part of the first face of the substrate which is arranged opposite the second zone of the second face of the substrate.

26. A label according to claim 25, wherein the second printing is covered by an opaque layer.

27. A label according to claim 26, wherein the opaque layer is a printed layer.

28. A label according to claim 26, wherein at least part of the first printing covers at least a portion of the opaque layer.

29. A label which can be applied to an article comprising:

a substrate including a first face and a second face, wherein said second face is intended to face an article when said label is applied to the article, and wherein said second face includes a first zone and a second zone;

a first printing covering at least part of said first face;

at least one adhesive associated with the first and second zones of said second face, wherein when the label is applied to the article the at least one adhesive holds the substrate to the article in both the first zone and the second zone, the at least one adhesive is in direct contact with the article in both the first zone and the second zone, and the first zone of said second face is adhered to said article more strongly than the second zone of said second face such that after the label is adhered to the article said second zone is peelably adhered to the article while the first zone is permanently adhered to the article; and a second printing which is visible in said second zone when looking at said second zone after the second zone is unstuck from the article, wherein the first zone directly abuts the second zone, and wherein each of the first and second zone are entirely covered by the at least one adhesive so as to be completely coated by the at least one adhesive.

30. A label according to claim 29, wherein said at least one adhesive includes a first adhesive in the first zone of said second face and a second adhesive in the second zone of said second face, and wherein the first adhesive is a permanent adhesive and the second adhesive is a reusable adhesive.

31. A label according to claim 29, wherein said second printing is disposed over at least part of the at least one adhesive in the second zone of the second face, and wherein the second printing decreases adherence strength of the at least one adhesive in the second zone.

32. A label according to claim 31, wherein the at least one adhesive includes the same adhesive in the first and second zones.

33. An article, comprising:

the label according to claim 29, wherein the label is applied to the article, and wherein the article includes a cosmetic product.

34. The article according to claim 33, wherein said article is a container which contains the cosmetic product.

35. The article according to claim 33, wherein said article is a bottle.

36. The article according to claim 33, wherein the article is opaque such that said second printing is only visible when said second zone is unstuck from said article.

37. The article according to claim 33, wherein said second printing is in contact with said article before the second zone is unstuck from said article.

38. The article according to claim 33, wherein the at least one adhesive includes a first adhesive in the first zone and a second adhesive different from the first adhesive in the second zone.

39. The article according to claim 38, wherein said second printing is disposed between said second adhesive and said substrate on the second face of said substrate in the second zone.

40. The article according to claim 38, wherein said first adhesive and said second adhesive are in contact with said article before the second zone is unstuck from the article.

41. The article according to claim 40, wherein the first adhesive is in contact with the second face of the substrate in the first zone, and further wherein the second printing is between the second adhesive and the second face of the substrate in the second zone.

42. The article according to claim 33, wherein the second printing is disposed between the at least one adhesive and the substrate in the second zone on the second face of the substrate.

43. The article according to claim 33, wherein the first zone is immediately adjacent to said second zone.

44. A label which can be applied to an article comprising:

a substrate including a first face and a second face, wherein said second face is intended to face an article when said label is applied to the article, and wherein said second face includes a first zone and a second zone;

a first printing covering at least part of said first face;

at least one adhesive associated with the first and second zones of said second face, wherein when the label is applied to the article the at least one adhesive holds the substrate to the article in both the first zone and the second zone, the at least one adhesive is in direct contact with the article in both the first zone and the second zone, and the first zone of said second face is adhered to said article more strongly than the second zone of said second face such that after the label is adhered to the article said second zone can be unstuck from the article while the first zone can remain adhered to the article; and a second printing which is visible in said second zone when looking at said second zone after the second zone is unstuck from the article, wherein at least part of the substrate in said second zone is formed of a non-opaque material, and wherein said second printing is associated with said first face of said substrate and said second printing is visible through the non-opaque material of the second zone after the second zone is unstuck from the article, and wherein the second printing is not visible when looking at said first face of said label.

45. A label according to claim 44, wherein at least a portion of the first printing superposes said second printing.

46. A label according to claim 44, wherein an opaque layer is disposed over said second printing on the first face of the substrate, and wherein said first printing is disposed over said opaque layer.

47. A label according to claim 46, wherein said at least one adhesive includes a first adhesive in the first zone of said second face and a second adhesive in the second zone of said second face.

48. An article, comprising:

a label comprising:

a substrate including a first face and a second face, wherein said second face is intended to face an article when said label is applied to the article, and wherein said second face includes a first zone and a second zone;

a first printing covering at least part of said first face;

at least one adhesive associated with the first and second zones of said second face, wherein when the label is applied to the article the at least one adhesive holds the substrate to the article in both the first zone and the second zone, the at least one adhesive is in direct contact with the article in both the first zone and the second zone, and the first zone of said second face is adhered to said article more strongly than the second zone of said second face such that after the label is adhered to the article said second zone can be unstuck from the article while the first zone can remain adhered to the article; and a second printing which is visible in said second zone when looking at said second zone after the second zone is unstuck from the article wherein the label is applied to the article, and wherein the article includes a cosmetic product, wherein the at least one adhesive includes a first adhesive in the first zone and a second adhesive different from the first adhesive in the second zone, wherein the substrate is at least partially transparent, and wherein said second printing is associated with said first face of said substrate and is visible through said second zone of said substrate when looking at said second zone on the second face of said substrate, and wherein an opaque layer is disposed over said second printing.

49. The article according to claim 48, wherein at least part of said first printing is disposed over at least a portion of said opaque layer.

50. The article according to claim 49, wherein said first adhesive and said second adhesive are in contact with said article before the second zone is unstuck from the article.

51. An article, comprising:

a label including a substrate including a first face and a second face, wherein said second face is intended to face an article when said label is applied to the article, and wherein said second face includes a first zone and a second zone;

a first printing covering at least part of said first face;

at least one adhesive associated with the first and second zones of said second face, wherein when the label is applied to the article the at least one adhesive holds the substrate to the article in both the first zone and the second zone, the at least one adhesive is in direct contact with the article in both the first zone and the second zone, and the first zone of said second face is adhered to said article more strongly than the second zone of said second face such that after the label is adhered to the article said second zone can be unstuck from the article while the first zone can remain adhered to the article; and a second printing which is visible in said second zone when looking at said second zone after the second zone is unstuck from the article, wherein at least part of the substrate in said second zone is formed of a non-opaque material, and wherein said second printing is associated with said first face of said substrate and said second printing is visible through the non-opaque material of the second zone after the second zone is unstuck from the article, wherein the label is applied to the article, and wherein the article includes a cosmetic product, wherein the substrate is at least partially transparent, and wherein said second printing is associated with said first face of said substrate and is visible through said second zone of said substrate when looking at said second zone on the second face of said substrate, and wherein an opaque layer is disposed over said second printing.

52. The article according to claim 51, wherein at least part of said first printing is disposed over at least a portion of said opaque layer.

* * * * *